US011118435B2

(12) United States Patent
Greci et al.

(10) Patent No.: US 11,118,435 B2
(45) Date of Patent: Sep. 14, 2021

(54) COMPLIANT SCREEN SHROUD TO LIMIT EXPANSION

(71) Applicant: Halliburton Energy Services, Inc., Houston, TX (US)

(72) Inventors: Stephen Michael Greci, Little Elm, TX (US); Michael Linley Fripp, Carrollton, TX (US); David Grant, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/779,293

(22) Filed: Jan. 31, 2020

(65) Prior Publication Data

US 2021/0238964 A1 Aug. 5, 2021

(51) Int. Cl.
*E21B 43/10* (2006.01)
*E21B 43/08* (2006.01)

(52) U.S. Cl.
CPC ..... *E21B 43/108* (2013.01); *E21B 43/086* (2013.01)

(58) Field of Classification Search
CPC ..... E21B 43/10; E21B 43/086
See application file for complete search history.

(56) References Cited

U.S. PATENT DOCUMENTS 6,158,507 A * 12/2000 Rouse ..... E21B 43/084 166/228
6,315,040 B1 * 11/2001 Donnelly ..... E21B 43/084 166/207
7,086,476 B2 8/2006 Johnson et al.
7,185,709 B2 3/2007 Schetky et al.
9,982,507 B2 5/2018 Murphree et al.
2003/0221840 A1 * 12/2003 Whitelaw ..... E21B 43/103 166/380
2004/0163819 A1 8/2004 Johnson et al.
2004/0261994 A1 12/2004 Nguyen et al.
2006/0037751 A1 2/2006 Mickelburgh et al.
2015/0204168 A1 7/2015 Greci
2017/0051583 A1 2/2017 Guest et al.

FOREIGN PATENT DOCUMENTS

WO WO-9717524 A2 * 5/1997 ..... B01D 29/21

OTHER PUBLICATIONS

Korean Intellectual Property Office, PCT/US2020/016272, International Search Report and Written Opinion, dated Oct. 20, 2020, 11 pages, Korea.

* cited by examiner

*Primary Examiner* — James G Sayre

(57) ABSTRACT

Compliant wellbores screens may be arranged to radially expand in a wellbore. The screens include an outer shroud layer including a perforation pattern thereon arranged for limiting the degree to which the screens are expand. The perforation patterns may permit the screens to be expanded to a predetermined limit by imparting a stable or relatively low expansion force. Once the predetermined limit is reached, the outer shrouds may require a sharp increase in the expansion force for further expansion. The sharp increase will prevent over-expansion of the screens, particularly where precise control over an expansion force imparted to expand the screens proves difficult. The perforation pattern may include arc-shaped perforations formed in sheet metal, spaces between braided metal strands, or many other arrangements.

20 Claims, 5 Drawing Sheets

COMPLIANT SCREEN SHROUD TO LIMIT EXPANSION

BACKGROUND

The present disclosure relates generally to completion systems for use in a subterranean wellbore. Example embodiments described herein include sand screens or other tubular equipment that may be expanded to a predetermined diameter within the wellbore.

In hydrocarbon production operations, it may be useful to convey generally tubular equipment into a subterranean wellbore to a predetermined location in a radially-retracted state, and then to outwardly expand the equipment in the wellbore. This procedure may facilitate passing the equipment past an obstruction in the wellbore, and/or to support an unconsolidated wellbore wall at the predetermined location. Expandable wellbore screens that have been employed provide support to the wellbore wall while filtering geologic fluids during production operations. In some instances, these wellbore screens may be expanded by passing an expansion tool therethrough, or by applying hydraulic pressure to the screens. In some instances, it may be desirable to limit the expansion of the screen so as to maintain the structural integrity of the screen. Using some methods for expanding the screens, however, it may be difficult to maintain a precise diameter of the screen without over expanding the screen.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure relates generally to compliant wellbores screens arranged to radially expand in a wellbore. The screens include an outer shroud layer including a perforation pattern thereon arranged for limiting the degree to which the screens may expand. The perforation patterns may permit the screens to be expanded to a predetermined limit by imparting a stable or relatively low expansion force. Once the predetermined limit is reached, the outer shrouds may require a sharp increase in the expansion force for further expansion. The perforation pattern may include arc-shaped perforations formed in sheet metal, spaces between braided metal strands, or many other arrangements.

Figure 1:
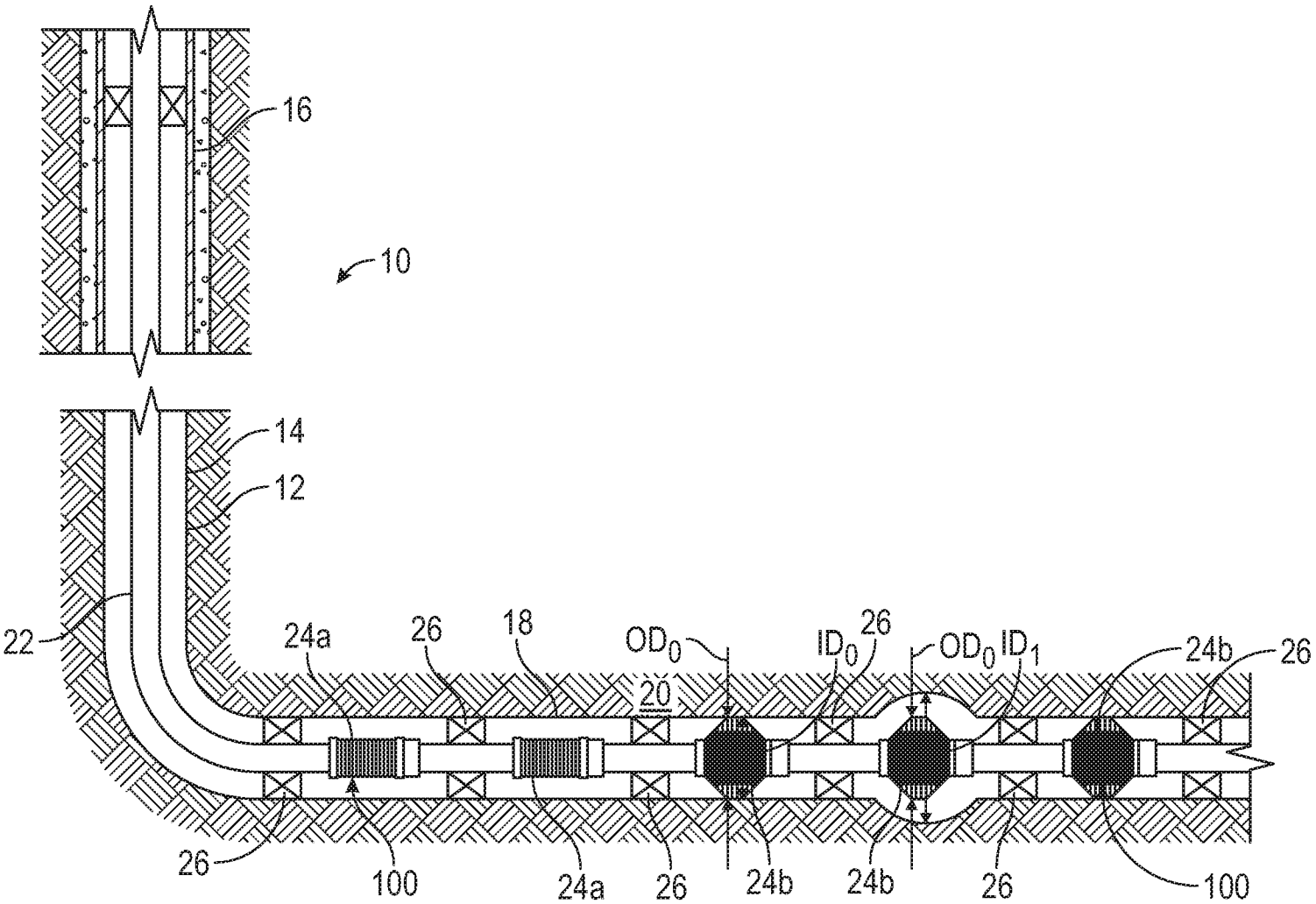
FIG. 1 is a partial, cross-sectional side view of a wellbore system including sand screens in both radially retracted and radially expanded configurations in accordance with aspects of the present disclosure.

Referring initially to FIG. 1, a wellbore system 10 includes a plurality of downhole fluid flow control screens 24*a*, 24*b* therein, which are equipped with an outer shroud 100 arranged for limiting the expansion of the fluid flow control screens 24*a*, 24*b* according to certain illustrative embodiments of the present disclosure. In the illustrated embodiment, a wellbore 12 extends through a geologic formation 20. Wellbore 12 has a substantially vertical section 14, the upper portion of which has a casing string 16 cemented therein. A substantially horizontal section 18 of wellbore 12 extends through a hydrocarbon bearing portion of the geological formation 20. As illustrated, substantially horizontal section 18 of wellbore 12 is open hole. In other embodiments, the wellbore 12 may be fully cased or extend along alternate trajectories including deviated or slanted portions, multilateral portions and other wellbore features without departing from the principles of the disclosure.

Positioned within wellbore 12 and extending from a surface location (not shown) is a tubing string 22. Tubing string 22 provides a conduit for hydrocarbons or other formation fluids to travel from formation 20 to the surface location and for injection fluids to travel from the surface to formation 20. At its lower end, the tubing string 22 defines a completion string that divides the horizontal section 18 into various production intervals adjacent to formation 20. The tubing string 22 includes a plurality of fluid flow control screens 24*a*, 24*b* coupled therein, each of which is positioned between a pair of annular barriers such as packers 26. The packers 26 provide a fluid seal between the tubing string 22 and geologic formation 20, thereby defining the production intervals. Any number of flow control screens 24*a*, 24*b* or other flow control devices may be deployed within a single production interval between packers 26, and/or within a completion interval that does not include production intervals without departing from the principles of the present disclosure. Generally, the flow control screens 24*a*, 24*b* may operate to filter particulate matter out of fluids collected from the formation 20 and may include flow restrictors therein to regulate the flow therethrough during production operations. Alternatively, or additionally, the flow control screens 24*a*, 24*b* may be operable to control the flow of an injection fluid stream from the tubing string 22 into the formation 20. Flow control screens 24*a* are illustrated in an initial, radially retracted configuration, which facilitates running the flow control screens in to the wellbore 12. The flow control screens 24*a* may be selectively expanded to assume the radially expanded configuration of flow control screens 24*b*. Generally, the flow control screens 24*b* in the expanded configuration exhibit an outer diameter $OD_0$ generally consistent with a nominal inner diameter $ID_0$ of the wellbore 12. Thus, the flow control screens 24*b* contact a wall 28 of the wellbore 12. In some instances, at least a portion of the wellbore 12 may exhibit an enlarged inner diameter ID, e.g., where significant washouts exist in the wellbore 12. As explained in greater detail below, the outer shroud 100 of the flow control screens 24*a*, 24*b* limit the degree to which the flow control screens 24*b* are expanded in the wellbore 12 such a flow control screen 24*b* in a portion of the wellbore 12 having an expanded inner diameter $ID_1$ may maintain an outer diameter $OD_0$ that is safe for the structural integrity of the flow control screens 24*b*.

Figure 2:
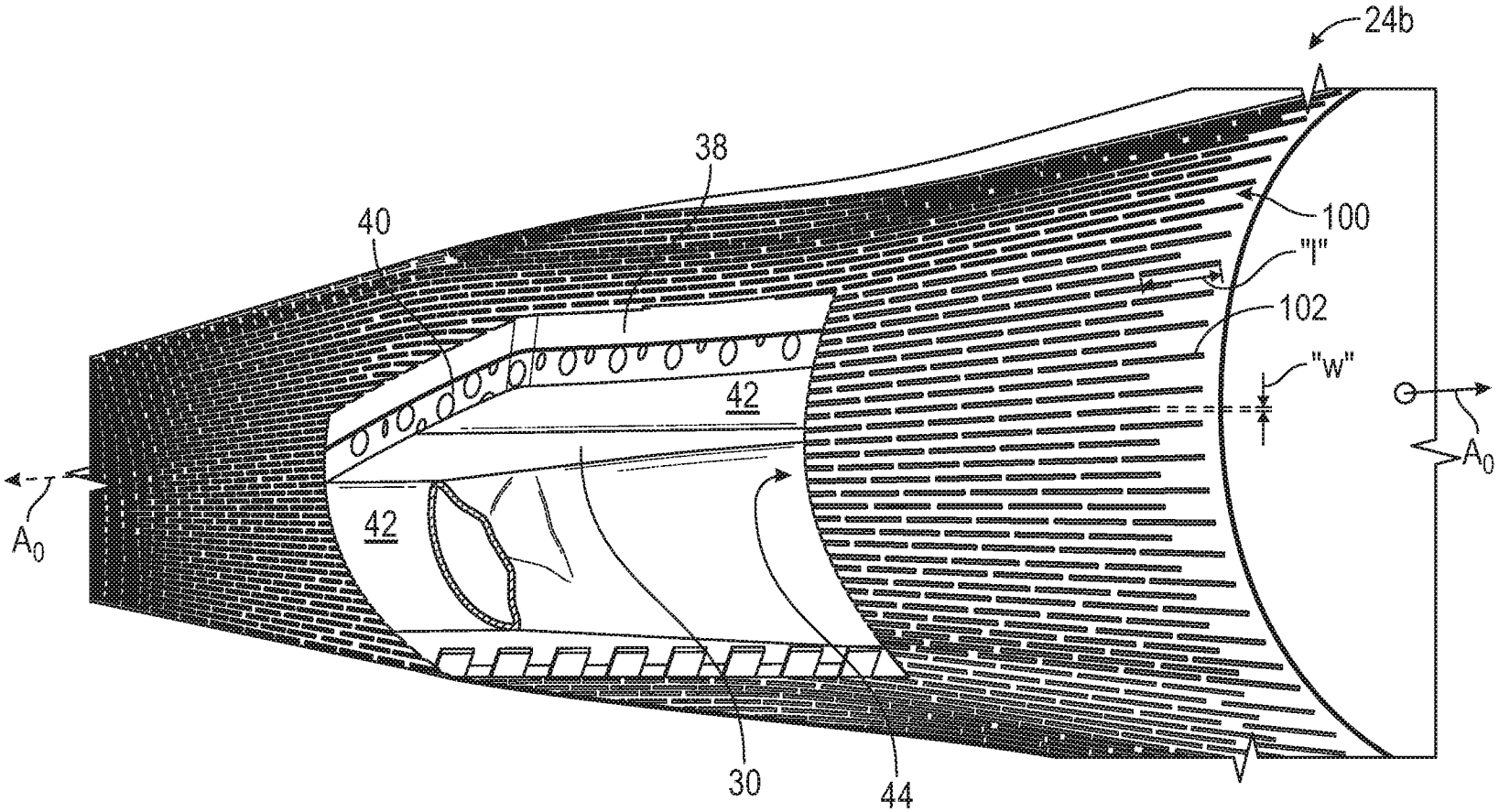
FIG. 2 is a perspective view of one of the sand screens of FIG. 1 in the radially expanded configuration and illustrated in broken form to reveal expandable chambers disposed below an outer shroud of the sand screen arranged to limit the expansion of the sand screen.

Referring to FIG. 2, a flow control screen 24*b* includes a base pipe 30, which may be connected in the tubing string 22 (FIG. 1). The base pipe 30 may receive production fluids from the geologic formation 20 surrounding the flow control screen 24*b*. The production fluids may first pass through an outer shroud 100, which may be constructed of a perforated metal sheet wrapped circumferentially around the base pipe 30. In some embodiments, A longitudinal seam (not shown) may secure edges of the outer shroud 100 to one another. The outer shroud 100 includes a pattern of elongated perforations 102 therein, which permits fluids to pass radially through the outer shroud 100, and also provides a predetermined degree of compliance to the outer shroud 100 that permit flow control screen 24*b* to expand radially to a predetermined diameter. The elongated perforations define a longitudinal length "l" generally aligned with a longitudinal axis $A_0$ of the outer shroud 100 and a circumferential width "w" around a circumference of the outer shroud. 100.

After passing through the outer shroud 100, the fluid may pass through one or more filtration layers 38. The filtration layers 38 are wrapped around the outside of the base pipe 30, and may be constructed as a filtration screen sheet, such as a sheet of wire mesh, composite mesh, plastic mesh, microperforated or sintered sheet metal or plastic sheeting, and/or any other sheet material capable of being used to form a tubular covering over the base pipe 30 and filter against passage of particulate larger than a specified size. Any one of the filtration layers 38 may extend circumferentially around all or any portion of the base pipe 30 and may be free to slide past one another as the flow control screen 24*b* expands. As illustrated, the filtration layers 38 are supported on a plurality of drainage layers 40, which are in turn located on top of expandable chambers 42. The drainage layers 40 may each be constructed of a relatively-rigid, apertured sheet that extends longitudinally along the base pipe 30. The drainage layers 40 are circumferentially offset relative to the chambers 42 such that, when the chambers 42 are activated, the drainage layers 40 bridge the channels 44 defined between the chambers 42. After passing through the drainage layers 40, the fluid may travel longitudinally along the channels 44 to at least one radial port (not shown) defined in the base pipe 30. In other embodiments (not shown), a single drainage layer may be provided over the expandable chambers 42. For example, a drainage layer may be constructed in tubular form substantially circumscribing each of the chambers 42 and/or channels 42. A hole and slot pattern may be provided through the tubular member in appropriate locations to permit flow into the channels 44 and/or to permit the tubular member to expand radially when the chambers 42 are activated.

Figure 3:
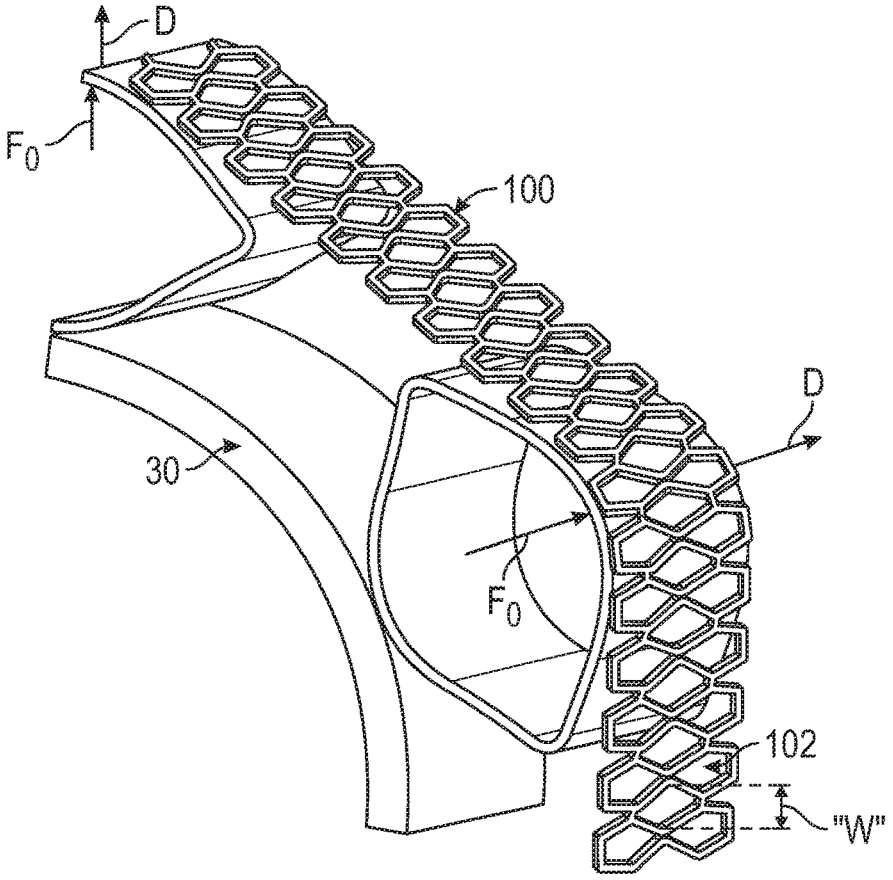
FIG. 3 is a partial, cross-sectional perspective view of the expandable chambers and the outer shroud of FIG. 2 carried on a base pipe.

Referring to FIG. 3, a section of the outer shroud 100 is illustrated in an expanded configuration. Expandable chambers 42 may be filled with a pressurized fluid such that the expandable chambers 42 apply a radial force $F_0$ to the outer shroud 100 to urge the outer shroud 100 to expand radially outward with respect to the base pipe 30. To permit a radial displacement D as the outer shroud 100 expands, the elongated perforations 102 are deformed into generally diamond shaped apertures. As the expandable chambers 42 are filled with fluid and the radial force $F_0$ is increased, the radial displacement of the outer shroud may increase in a non-linear manner.

Figure 4:
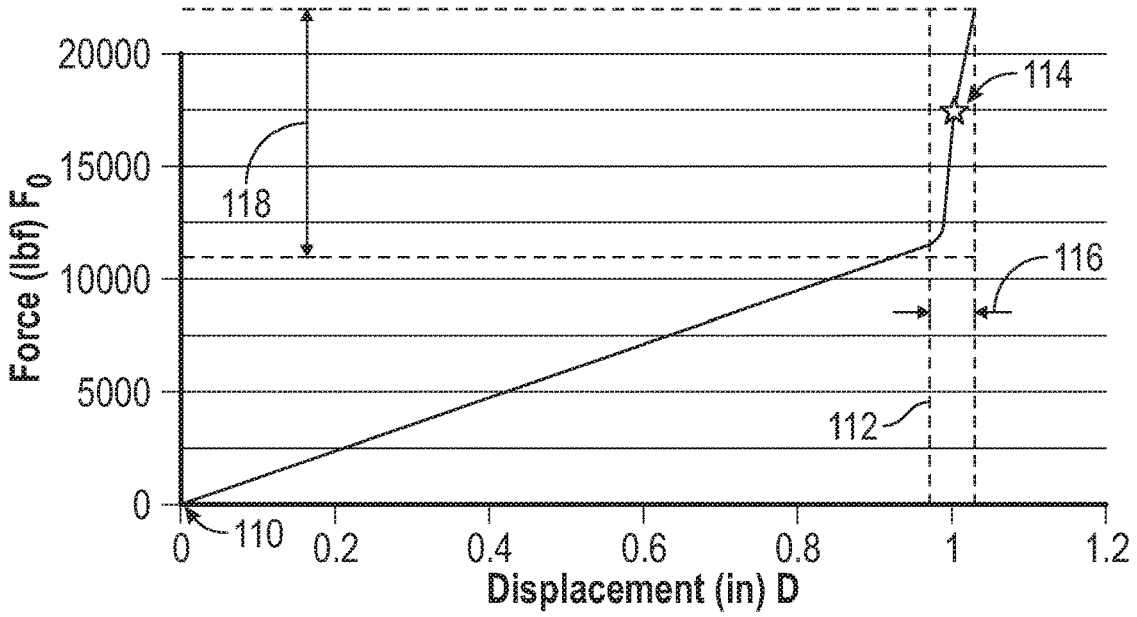
FIG. 4 is a graphical representation of the displacement of the outer shroud of FIG. 3 induced by a variable expansion force provided by the expandable chambers.

As illustrated in FIG. 4, an expansion curve for the outer shroud 100 is illustrated. Beginning from an initial configuration 110 where the radial displacement is zero of the outer shroud 100 is zero, increasing the radial force $F_0$ initially induces a radial displacement of the outer shroud 100 in a generally linear manner. The linear increase may continue until the displacement D reaches a predetermined limit 112. Above the limit 112, further increases in the force $F_0$ impart only a relatively small radial displacement D of the outer shroud 100. For example, in some embodiments, for each lbf increase in the radial force $F_0$ beyond the limit 112, only a 10% increase in the radial displacement D may be induced compared to each lbf increase in the radial force below the limit 112. Thus, the expansion curve exhibits a sharp increase in slope or acceleration at the limit 112. In some embodiments, the expansion curve exhibits at least a 10% increase in slope at the limit 112, and in other embodiments, the expansion curve exhibits at least a 50% increase in slope at the limit 112. The limit 112 may represent a point in the deformation of the apertures 102 (FIG. 3) where the shape of the apertures 102 has reached a maximum circumferential with dimension "w," and where further displacement requires an elongation or stretching of the material between the apertures 102. Where a target radial displacement 114 is identified having a tolerance 116, a relatively large range 118 of the radial force $F_0$ may be supplied to achieve the target radial displacement 114. Generally, the range of displacement D associated with the tolerance 116 will encompass a displacement determined to deform the outer shroud 100 to have an outer diameter $OD_0$ consistent with a nominal expected inner diameter $ID_0$ of the wellbore (FIG. 1). The limit 112 is generally defined just below or at the target radial displacement 114 along the expansion curve. In some embodiments, the limit 112 may be within the predetermined tolerance 116 of about 5% of the target radial displacement 114. In other embodiments, the limit 112 may be within a predetermined tolerance 116 of about 10% or 25% of the target radial displacement 114.

Figure 5A:
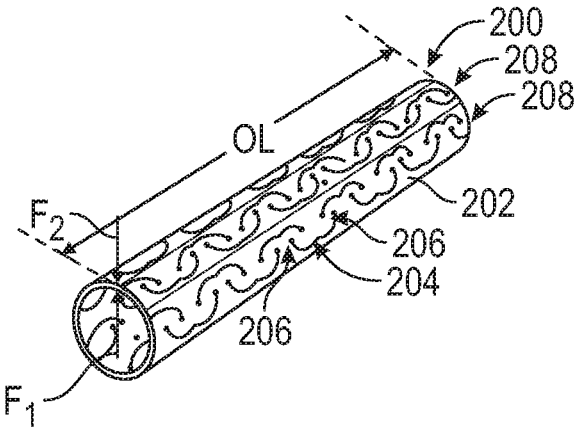
FIGS. 5A and 5B are perspective views of an alternate embodiment of an outer shroud layer in radially retracted and expanded configurations, respectively, the outer shroud including arc-shaped perforations defined therein for limiting the expansion of a sand screen.
Figure 5B:
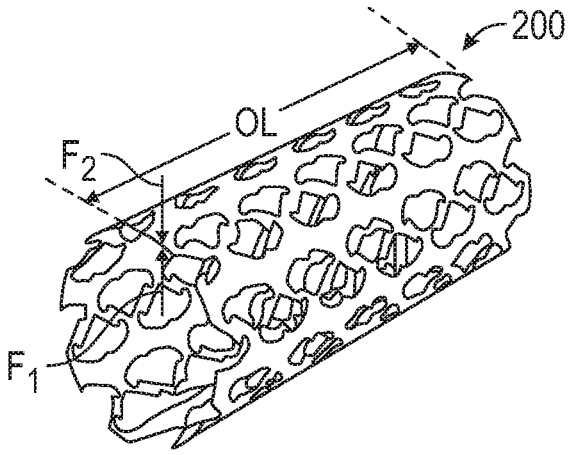

Referring to FIGS. 5A and 5B, an alternate embodiment of an outer shroud 200 is illustrated in an initial radially retracted configuration (FIG. 5A) and a radially expanded configuration (FIG. 5B). The outer shroud 200 may be constructed of a tube of sheet metal such as stainless steel and defines a pattern of arc-shaped perforations 202 therein. When the outer shroud 200 is in the radially retracted configuration, the arc-shaped perforations 202 include a dimple 204 defined in an approximate midsection thereof and holes 206 defined at the longitudinal ends of each perforation 202. The perforations 202 may completely penetrate the tubular structure of the outer shroud 200 such that fluids may pass radially therethrough. The perforations 202 are arranged in a plurality of rows 208 disposed about the circumference of the outer shroud 200 with opposed longitudinally offset perforations 202 in each row 208.

When a radial force $F_1$ is applied to move the outer shroud 200 to the radially expanded configuration of FIG. 5B, the perforations 202 circumferentially extend, which permits the outer shroud 200 to expand to a larger outer diameter without changing in overall length OL. Upon expansion of the perforations 202, the perorations 202 assume a wedge-shaped perimeter defined by the dimples 204 and holes 206. The number, length and spacing of the perforations 202 may be varied such that a limit above which further expansion of the outer shroud 202 is relatively resistant to the application of additional radial force may be defined.

Figure 6:
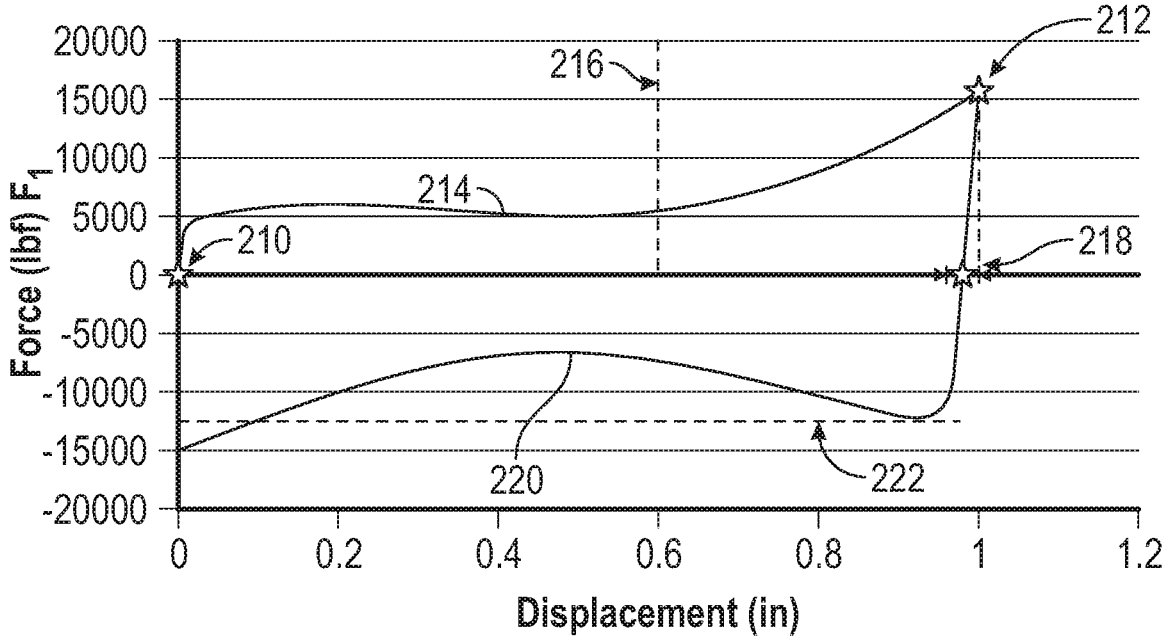
FIG. 6 is a graphical representation of the displacement of the outer shroud of FIGS. 5A and 5B induced by a variable expansion force.

As illustrated in FIG. 6, the force $F_1$ required to radially expand the outer shroud from an initial configuration where the displacement 210 of the outer shroud 200 is zero to a target displacement 212 is generally non-linear and follows expansion curve 214. Initially, the expansion force $F_1$ is generally constant. An expansion force $F_1$ of about 5000 lbf may be applied to expand the outer shroud by about 0.6 inches. A limit 216 is defined above which further expansion requires increasingly more force. After the limit 216, about an additional 10,000 lbf is required to further displace the outer shroud 200 to the target displacement 212. The target displacement 212 may be maintained by sealing expandable chambers 42 (FIG. 3) with a sufficient fluid pressure contained therein. Alternatively, the pressure may be removed from the expandable chambers 42 to permit the outer shroud 200 to recoil to a target displacement 218 depending on the operations to be conducted in the wellbore. To fully retract the outer shroud 200 back to the initial zero displacement configuration, a force $F_2$ may be applied to the outer shroud 200 in a direction opposite the expansion force F. The required force $F_2$ to fully retract the outer shroud generally follows retraction curve 220. In practice, it might not be necessary to fully retract the outer shroud 200 in a wellbore, but the retraction curve 220 exhibits a limit 222 at a force F of about −12,500 lbf above which the outer shroud 200 generally maintains the target displacement 218. Thus, the outer shroud 200 may accommodate significant radial loads in operation.

Figure 7:
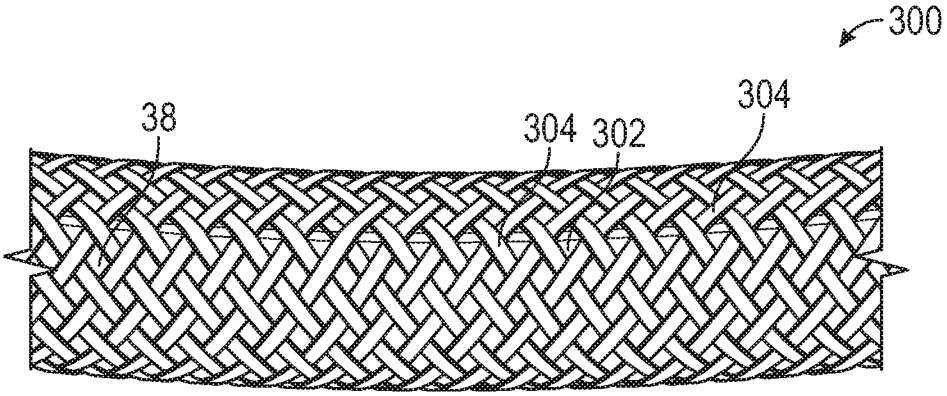
FIG. 7 is a perspective view of another alternate embodiment of an outer shroud layer including braided wires arranged for limiting the expansion of a sand screen.

Referring now to FIG. 7, an alternate embodiment of an outer shroud 300 is illustrated over one or more filtration layers 38 in manner similar to the outer shroud 100 (FIG. 2). The outer shroud 300 includes a plurality of perforations 302 defined between a plurality of braided metal wires strands 304. If a radially outward expansion force is applied to the outer shroud 300, the outer shroud 300 will initially provide minimal resistance where the strands 304 move past one another to remove any slack in the outer shroud. Once all the slack is removed, a limit may be defined where further expansion of the shroud 300 may require actually stretching each of the strands 304. A sharp increase in the expansion force required for further expansion will be defined at the limit. The outer shroud 300 may be provided as the outermost layer of a sand screen as illustrated in FIG. 7, or the outer shroud may be provided in other positions in a sand screen. For example, the outer shroud 300 may be provided beneath the filtration layers 38 and function in a similar manner to limit over expansion of the sand screen.

Figure 8:
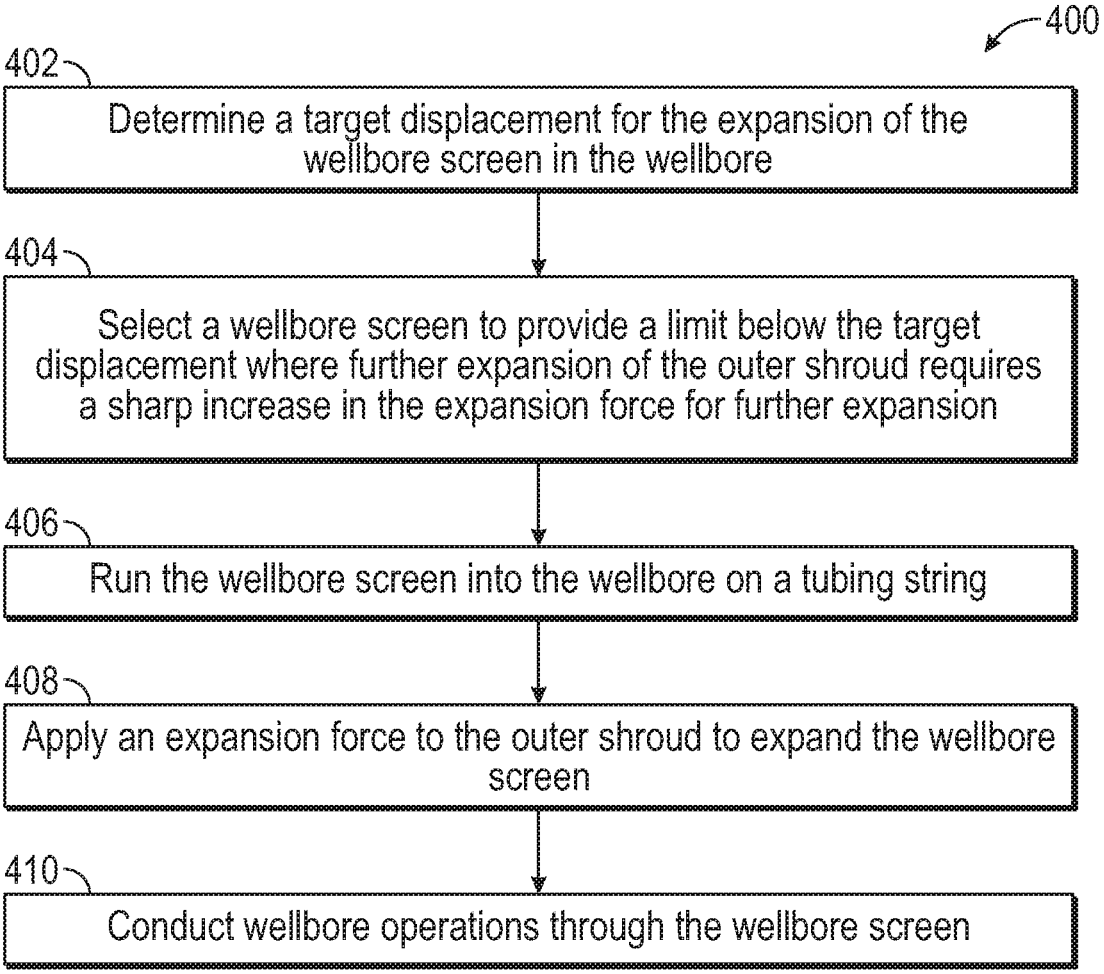
FIG. 8 is a flowchart illustrating an operational procedure for employing a wellbore screen.

Referring to FIG. 8, an operational procedure 400 for employing any of the sand screens described above is described. Initially at step 402, a target displacement for the expansion of the wellbore screen in the wellbore is determined. The target displacement may be selected such that a target outer diameter for the wellbore screen expanded by the target displacement is slightly larger the nominal inner diameter of the wellbore such that the wellbore screen will contact the wellbore wall when expanded.

Next, at step 404, the wellbore screen is selected to include an outer shroud having a plurality of perforations defined therein, wherein the perforations are arranged in a pattern which will provide a limit below the target displacement where further expansion of the outer shroud requires an increase in the expansion force for further expansion. Thus, the wellbore screen is selected to expand at least to the limit to reach the target displacement and the outer shroud may protect against over-expansion of the screen by providing an increased resistance to further expansion beyond the limit.

At step 406, the wellbore screen may be run into the wellbore on a tubing string, and at step 408 an expansion force is applied to the outer shroud to expand outer shroud to the target displacement within a predetermined tolerance. The expansion force may be applied by an expansion mechanism including one or more expandable chambers carried by the base pipe that expand in response to being filled with a pressurized fluid. In other embodiments, an expansion mechanism may be deployed on a conveyance separate from the base pipe.

At step 410, with the wellbore screen expanded in the wellbore, downhole operations may be conducted through the screen. For example, fluids may be injected or produced through the perforations defined outer shroud.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect of the disclosure, a method of deploying a wellbore screen includes (a) determining a target displacement for the expansion of the wellbore screen in the wellbore, (b) selecting the wellbore screen that includes an outer shroud having a plurality of perforations defined therein, the perforations arranged in a pattern which will permit the outer shroud to expand to the target displacement in response to an expansion force applied thereto, the target displacement at a limit where further expansion of the outer shroud requires an increase in the expansion force for further expansion, (c) running the wellbore screen into the wellbore on a tubing string and (d) applying the expansion force to the outer shroud to expand outer shroud to the target displacement.

In one or more embodiments, the method further includes filling an expandable chamber disposed beneath the outer shroud with a pressurized fluid and applying the expansion force to the outer shroud with the expandable chamber. The method may further include stretching a material defined between perforations in the outer shroud in response to applying the expansion force to displace the outer shroud beyond the limit. In some embodiments, the method includes removing slack in an arrangement of braided strands in response to applying the expansion force to displace the outer shroud up to the limit.

In some embodiments, determining the target displacement includes selecting a target outer diameter for the wellbore screen expanded by the target displacement wherein the target outer diameter is at least an inner diameter of the wellbore. In some embodiments, applying the expansion force to the outer shroud induces the outer shroud to expand to within a predetermined tolerance of about 25% of the limit and the target displacement. The method may further include maintaining a longitudinal length of the outer shroud while applying the expansion force to expand the outer shroud. The method may further include at least one of the group consisting of injecting fluid and producing fluid through the plurality of perforations in the wellbore.

According to another aspect, the disclosure is directed to a wellbore screen system. The wellbore screen system includes a base pipe connected in a tubing string and a filtration layer disposed around the base pipe, the filtration layer forming a tubular covering over the base pipe and operable filter against passage of particulates larger than a specified size. The wellbore screen system further includes an outer shroud disposed around the base pipe, the outer shroud having a plurality of perforations defined therein, the perforations arranged in a pattern which will provide a limit at a target displacement where further expansion of the outer shroud requires an increase in the expansion force for further expansion.

In some embodiments, the wellbore screen system further includes an expansion mechanism carried on the base pipe and selectively operable to apply the expansion force to the outer shroud. The expansion mechanism may include at least one expandable chamber disposed beneath the outer shroud and responsive to being filled with a pressurized fluid to apply the expansion force to the outer shroud. In some embodiments, the wellbore screen system further includes a drainage layer bridging a flow channel defined between adjacent expandable chambers of the at least one expandable chamber. The outer shroud may include a plurality of braided strands arranged to include a predetermined amount of slack therein, wherein the limit is defined where the slack is removed. In some embodiments, the outer shroud is disposed beneath the filtration layer.

In one or more embodiments, the outer shroud includes a sheet metal layer comprising a plurality of elongated perforations defined therethrough to provide compliance to the outer shroud. The elongated perforations may include a plurality of elongated arc-shaped perforations having a dimple defined at an approximate midsection thereof. In some embodiments, the limit is defined at an acceleration of the expansion force required for further radial displacement of the outer shroud. In some embodiments, for each unit of increase in the expansion force beyond the limit only a 10% increase in the radial displacement is induced compared to each unit increase in the expansion force below the limit.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A method of deploying a wellbore screen, the method comprising:

determining a target displacement for the expansion of the wellbore screen in the wellbore;

selecting the wellbore screen that includes an outer shroud having a plurality of perforations defined therein, the perforations arranged in a pattern which will permit the outer shroud to expand to the target displacement in response to an expansion force applied thereto, the target displacement at a limit where further expansion of the outer shroud requires an increase in the expansion force for further expansion, and wherein the limit is defined at an acceleration of the expansion force required for further radial displacement of the outer shroud;

running the wellbore screen into the wellbore on a tubing string; and applying the expansion force to the outer shroud to expand the outer shroud to the target displacement.

2. The method of claim 1, further comprising filling an expandable chamber disposed beneath the outer shroud with a pressurized fluid and applying the expansion force to the outer shroud with the expandable chamber.

3. The method of claim 1, further comprising stretching a material defined between perforations in the outer shroud in response to applying the expansion force to displace the outer shroud beyond the limit.

4. The method of claim 3, further comprising removing slack in an arrangement of braided strands in response to applying the expansion force to displace the outer shroud up to the limit.

5. The method of claim 1, wherein determining the target displacement includes selecting a target outer diameter for the wellbore screen expanded by the target displacement wherein the target outer diameter is at least an inner diameter of the wellbore.

6. The method of claim 1, wherein applying the expansion force to the outer shroud induces the outer shroud to expand to within a predetermined tolerance of about 25% of the limit and the target displacement.

7. The method of claim 1, further comprising maintaining a longitudinal length of the outer shroud while applying the expansion force to expand the outer shroud.

8. The method of claim 1, further comprising at least one of the group consisting of injecting fluid and producing fluid through the plurality of perforations in the wellbore.

9. A wellbore screen system, comprising a base pipe connected in a tubing string;

a filtration layer disposed around the base pipe, the filtration layer forming a tubular covering over the base pipe and operable filter against passage of particulates larger than a specified size; and an outer shroud disposed around the base pipe, the outer shroud having a plurality of perforations defined therein, the perforations arranged in a pattern which will provide a limit at a target displacement where further expansion of the outer shroud requires an increase in the expansion force for further expansion, wherein the limit is defined at an acceleration of the expansion force required for further radial displacement of the outer shroud.

10. The wellbore screen system of claim 9, further comprising an expansion mechanism carried on the base pipe and selectively operable to apply the expansion force to the outer shroud.

11. The wellbore screen system of claim 10, wherein the expansion mechanism comprises at least one expandable chamber disposed beneath the outer shroud and responsive to being filled with a pressurized fluid to apply the expansion force to the outer shroud.

12. The wellbore screen system of claim 11, further comprising at least one drainage layer bridging a flow channel defined between adjacent expandable chambers of the at least one expandable chamber.

13. The wellbore screen system of claim 9, wherein the outer shroud comprises a plurality of braided strands arranged to include a predetermined amount of slack therein, wherein the limit is defined where the slack is removed.

14. The wellbore screen system of claim 13, wherein the outer shroud is disposed beneath the filtration layer.

15. The wellbore screen system of claim 9, wherein the outer shroud comprises a sheet metal layer comprising a plurality of elongated perforations defined therethrough to provide compliance to the outer shroud.

16. The wellbore screen system of claim 15, wherein the elongated perforations include a plurality of elongated arc-shaped perforations having a dimple defined at an approximate midsection thereof.

17. The wellbore screen system of claim 9, wherein for each unit of increase in the expansion force beyond the limit only a 10% increase in the radial displacement is induced compared to each unit increase in the expansion force below the limit.

18. A wellbore screen system, comprising a base pipe connected in a tubing string;

a filtration layer disposed around the base pipe, the filtration layer forming a tubular covering over the base pipe and operable filter against passage of particulates larger than a specified size; and an outer shroud disposed around the base pipe, the outer shroud having a plurality of perforations defined therein, the perforations arranged in a pattern which will provide a limit at a target displacement where further expansion of the outer shroud requires an increase in the expansion force for further expansion;

wherein the outer shroud comprises a plurality of braided strands arranged to include a predetermined amount of slack therein, wherein the limit is defined where the slack is removed.

19. The wellbore system of claim 18, wherein the limit is defined at an acceleration of the expansion force required for further radial displacement of the outer shroud.

20. The wellbore system of claim 19, wherein for each unit of increase in the expansion force beyond the limit only a 10% increase in the radial displacement is induced compared to each unit increase in the expansion force below the limit.

* * * * *